United States Patent [19]

Frostig

[11] 4,365,560

[45] Dec. 28, 1982

[54] FIN-STABILIZED PROJECTILE

[75] Inventor: Amos Frostig, Haifa, Israel

[73] Assignee: Etablissement Salgad, Vaduz/Liechtenstein, Fed. Rep. of Germany

[21] Appl. No.: 185,042

[22] Filed: Sep. 8, 1980

[30] Foreign Application Priority Data

Sep. 11, 1979 [DE] Fed. Rep. of Germany ... 7925652[U]

[51] Int. Cl.[3] ..... F42B 13/02

[52] U.S. Cl. ..... 102/477; 102/479; 102/493; 102/497; 102/506

[58] Field of Search ..... 102/477–479, 102/493, 497, 506, 372, 374

[56] References Cited

U.S. PATENT DOCUMENTS

| | | | |
|---|---|---|---|
| 1,367,464 | 2/1921 | Cook | 102/493 X |
| 2,007,026 | 7/1935 | Robertson | 102/493 X |
| 2,037,308 | 4/1936 | Brandt | 102/373 |
| 2,070,946 | 2/1937 | Joyce | 102/373 |
| 2,113,313 | 4/1938 | Brandt | 102/373 X |
| 3,576,165 | 4/1971 | Gawlick et al. | 102/373 X |
| 3,815,504 | 6/1974 | Tieben | 102/496 |
| 3,882,779 | 5/1975 | Frostig | 102/372 |
| 4,016,816 | 4/1977 | Larsson et al. | 102/494 |

FOREIGN PATENT DOCUMENTS

| | | | |
|---|---|---|---|
| 228092 | 6/1963 | Austria | 102/373 |
| 617519 | 4/1961 | Canada | 102/477 X |
| 2149078 | 3/1973 | France | 102/494 |

*Primary Examiner*—Peter A. Nelson

*Attorney, Agent, or Firm*—Neil F. Markva

[57] ABSTRACT

The fin-stabilized projectile has an ogival projectile body having a nose portion and a base portion joined to a tail tube having a finned tailed unit. The nose and base portions are fixedly secured to respective ends of an internal connecting tube. The tube has a plurality of recesses disposed around the peripheral outer surface of the internal connecting tube. A bursting charge is formed along the outer peripheral surface of the connecting tube and the material used to form the bursting charge fills the recesses to provide a distribution of thrust forces along the length of the bursting charge, which is disposed between the nose and base portions.

2 Claims, 1 Drawing Figure

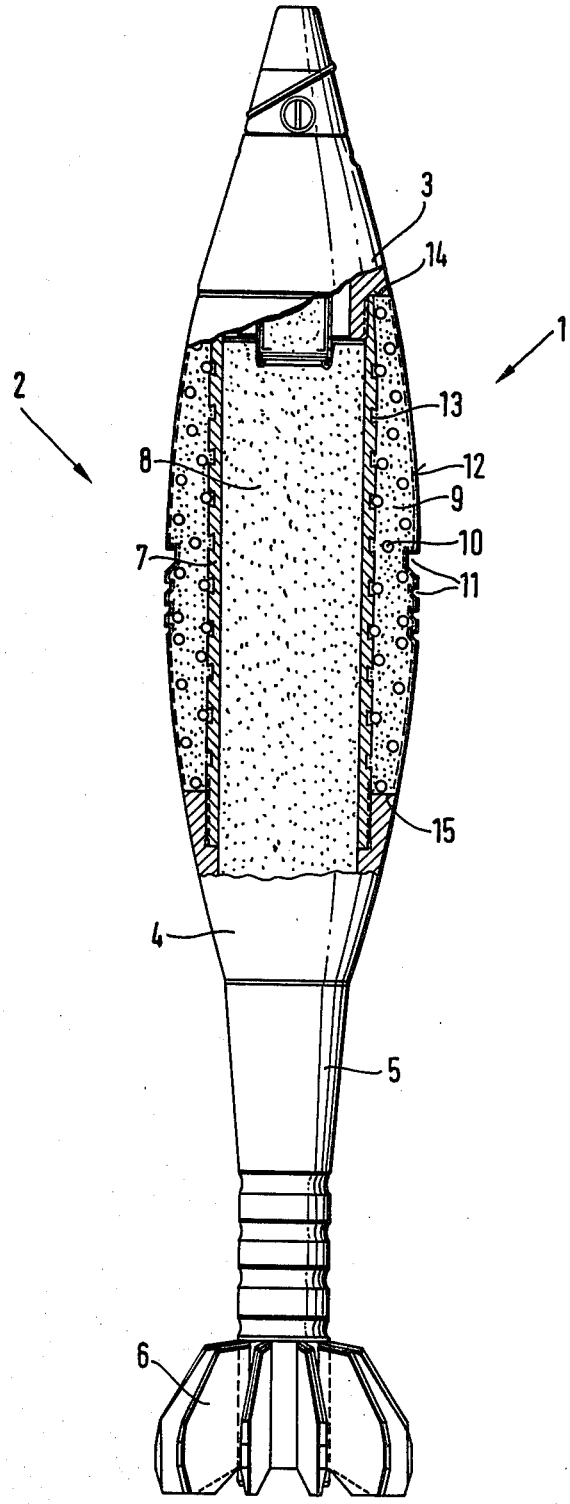
1
2
3
14
13
12
9
10
11
8
7
15
4
5
6

FIN-STABILIZED PROJECTILE

FIELD OF THE INVENTION

This invention relates to fin-stabilized projectiles having an ogival projectile body which includes a nose portion and a base portion and is joined to a tail tube having a finned tail unit.

BACKGROUND OF THE INVENTION

Fin-stabilized projectiles having a bursting charge containing shrapnel fragments such as steel balls and the like are well known. The shrapnel fragments are embedded in an embedding substance such as a plastic material. In a known projectile of this type, the nose and base portions of the projectile body are rigidly connected to respective ends of an internal connecting tube. The bursting charge containing the shrapnel fragments is formed in the vacant space surrounding the internal connecting tube between the nose and base portions of the ogival body.

It is also known to form the bursting charge containing the shrapnel fragments in such a manner as to not confine the shrapnel at the ogival peripheral area by a jacket casing surrounding such a bursting charge. Consequently, the full effect of the detonation can be expended on the bursting forth of the shrapnel fragments. That is, the force of the detonation need not provide energy to break through an outer jacket of steel or the like.

It is known that a sudden, very high acceleration occurs upon the discharge of the fin-stabilized projectile from the mortar barrel from which it is fired. Consequently, the bursting charge is exposed to very high thrust forces in the axial direction thereof with these forces being equivalent to an impact load on the bursting charge. The internal connecting tube may react to the very high thrust forces in a different manner than the bursting charge because the properties of the material in each of these parts are different, and their location with respect to the thrust forces is completely different. That is, the bursting charge is disposed between relatively small annular surface areas between the nose and base portions of the shell body. On the other hand, the internal connecting tube is rigidly connected with the nose and base portions. Because of the different effects of the stresses upon firing of and discharging the projectile from the barrel of the firearm, a stable unity between the projectile body and the bursting charge containing the shrapnel fragments is endangered. The bursting charge comes into direct contact with the inner tube or barrel wall upon discharge of the projectile because of its unencumbered peripheral area. Thus, the bursting charge is subject to additional stresses which may also impair the cohesion between the bursting charge and the internal connecting tube.

SUMMARY OF THE INVENTION

The primary object of the invention is to produce a projectile body in which the stress is acting on the bursting charge containing the shrapnel fragments is significantly reduced under the effect of the discharge forces. The fin-stabilized projectile as described herein is designed to disperse the stresses acting on the bursting charges onto other portions of the projectile body so that the ogival projectile body of the fin-stabilized projectile becomes generally more resistant. The projectile made in accordance with this invention has an internal connecting tube which includes recesses along its outer peripheral surface area in which the material of the bursting charge flows during its formation around the outer peripheral surface of said tube. The recesses have radially extending surfaces which add to the overall radial surface already provided at the respective ends of the internal connecting tube which ends are rigidly connected to the nose and base portions of the projectile body.

The shrapnel containing bursting charge is disposed between the nose and base portions which are rigidly connected to the respective ends of the connecting tube. Substantial increases in the thrust forces from the projectile body may be distributed therefor over a much larger surface area in a very simple manner. That is, the specific pressure per unit area acting upon the bursting charge and internal connecting tube is considerably reduced. The advantages of this invention are more specifically discussed hereinbelow.

BRIEF DESCRIPTION OF DRAWING

Other objects of this invention will appear in the following description and appended claims, reference being made to the sole accompanying drawing which forms a part of the specification. The only drawing is a diagrammatic elevational view partly in cross section of a fin-stabilized projectile made in accordance with this invention.

DETAILED DESCRIPTION

The fin-stabilized projectile, generally designated 1, has an ogival projectile body 2, a nose portion 3, a base portion 4, a tail tube 5 and a finned tail unit 6. The nose and base portions 3 and 4 are rigidly bolted together with an internal connecting tube 7 so that the nose and base portions 3 and 4 bear upon respective ends of the internal tube 7 as shown. An explosive charge 8 is located within the steel connecting tube 7 and is ignited when the projectile 1 strikes via an igniter located at the nose of projectile 1.

A bursting charge 9 is disposed around the outside of connecting tube 7 and extends from nose portion 3 to base portion 4 of projectile body 2. Bursting charge 9 comprises an embedding substance such as a plastics material having shrapnel such as balls 10 embedded therein. The external periphery of bursting charge 9 has an ogival shape as is usual with finned stabilized projectiles of this type.

Grooves 11 are located in the zone of greatest diameter of the ogival projectile body 2. Grooves 11 are formed in the exterior surface of bursting charge 9 and achieve a damming effect of the propellant gases within the tube or firearm barrel when the projectile is fired therefrom. That is, grooves 11 prevent the propellant gases from breaking through forwardly of the projectile and thus the projectile leaves the barrel of the firearm as free from oscillation as possible. Bursting charge 9 is free of any jacket of material such as steel or other high strength material. Consequently, the effect of the detonation of explosive charge 9 is fully concentrated upon hurling forth or throwing outwardly the shrapnel 10 without having to provide energy to disintegrate such a jacket encasing. The embedding substance of bursting charge 9 may include fibers 12 disposed close to the external periphery, thereby strengthening the plastics material of charge 9.

The internal connecting tube 7 includes recesses 13 distributed substantially uniformly over the length of the external periphery of tube 7. In this particular embodiment, the recesses 13 are formed as annular grooves which are undercut in cross section to provide anchorage or rigid connection between the embedding substance of charge 9. As is known, the radial surfaces 14 and 15 of connecting tube 7 are subjected to thrust forces of very high magnitude upon the discharge of finned stabilized projectile 1 from the barrel of a firearm. The recesses 13 include radial surfaces which substantially increase or add to the radial surfaces 14 and 15. Consequently, the bursting charge 9 is stressed substantially more uniformly along its entire length during the firing phase than was possible with known devices. Furthermore, the danger of rupture, breaking loose or crumbling of the plastic material in bursting charge 9 is considerably reduced.

Additionally, the cohesion between nose portion 3, connecting tube 7 and base portion 4, with respect to bursting charge 9, is considerably improved with respect to the stress formed during the discharge phase of projectile 1 along with the comparability of the pressure load on the plastic material of bursting charge 9. Thus, the finned stabilized projectile 1 as disclosed herein attains a greater reliability in carring out the effect for which it has been developed.

Recesses 13 may have different formations with respect to their cross-sectional profile. However, the annular grooves as discussed above provided with the undercut is most effective in securing the connecting tube 7 with the bursting charge 9. The embedding substance of charge 9 is kept fully restrained over the entire height thereof at various positions with respect to the axially acting thrust forces. Transmissive effect of the thrust forces arising upon discharge of projectile 1 from the barrel of a firearm is significantly mitigated. Furthermore, unity between bursting charge 9 and tube 7 is considerably improved stress-wise. Through this particular configuration of recesses 13, the thrust is better absorbed at the bursting charge 9 directly on differential effect of the thrust forces acting on the internal tube 7 and bursting charge 9. The very large pressure effect upon the bursting charge 9 during firing is more efficiently prevented. Finally, with the energy of the explosive charge 8 being substantially focused upon the hurling forth of the shrapnel balls 10, the range of the projectile is increased. The recesses 13 effectively aid in holding the bursting charge 9 and therefore an outer jacket casing for charge 9 is unnecessary.

While the fin-stabilized projectile has been shown and described in detail, it is obvious that this invention is not to be considered as being limited to the exact form disclosed, and that changes in detail and construction may be made therein within the scope of the invention, without departing from the spirit thereof.

I Claim:

1. A fin-stabilized projectile for firing from the barrel of a firearm, said projectile comprising:

(a) an ogival projectile body having a nose portion and a base portion, a tail tube connected to said body and having a finned tail unit, (b) said nose and base portions being rigidly connected at respective ends of an internal connecting tube made of steel, (c) a charge portion including a bursting charge disposed around the steel internal tube and being composed of a rigid plastic material which forms a matrix in which shrapnel fragments are imbedded, (d) said bursting charge forming the ogival projectile body shape with the outer surface thereof being of a diameter which may contact the inner wall of the barrel of the firearm from which the projectile is being fired, (e) said steel internal tube having undercut annular grooves with radially extending surfaces and being disposed on the total external surface thereof and along the length of said bursting charge containing the shrapnel fragments, (f) said rigid plastic material filling said undercut annular grooves.

2. A fin-stabilized projectile as defined in claim 1 wherein:

said bursting charge is free of any outer jacket casing composed of a high strength material.

* * * * *